United States Patent [19]

Yokoi et al.

[11] Patent Number: 4,661,686

[45] Date of Patent: Apr. 28, 1987

[54] DUAL LINE CERAMIC GLOW PLUG

[75] Inventors: Shinichi Yokoi; Tsuneo Itoh, both of Aichi; Seishi Yasuhara; Hiroshi Kondo, both of Kanagawa, all of Japan

[73] Assignees: NGK Spark Plug Co., Ltd, Aichi; Nissan Motor Co., Ltd, Kanagawa, both of Japan

[21] Appl. No.: 722,461

[22] Filed: Apr. 12, 1985

[30] Foreign Application Priority Data

Apr. 12, 1984 [JP] Japan ..... 59-71795
Apr. 12, 1984 [JP] Japan ..... 59-71796

[51] Int. Cl.[4] ..... F23Q 7/00; F02P 19/02; H05B 3/00

[52] U.S. Cl. ..... 219/270; 123/145 A; 219/267; 219/541; 219/553; 361/264

[58] Field of Search ..... 219/267, 270, 541, 544, 219/553, 205; 123/145 R, 145 A; 361/264, 266; 29/611, 620, 621

[56] References Cited

U.S. PATENT DOCUMENTS 4,401,065 8/1983 Minegishi et al. ..... 123/145 A
4,425,692 1/1984 Minegishi et al. ..... 29/611
4,466,391 8/1984 Page ..... 123/145 A
4,499,366 2/1985 Yoshida et al. ..... 219/270
4,502,430 3/1985 Yokoi et al. ..... 123/145 A
4,563,568 1/1986 Takizawa ..... 123/145 A X

FOREIGN PATENT DOCUMENTS 138923 8/1983 Japan ..... 219/205
119045 8/1983 Japan .

*Primary Examiner*—Anthony Bartis
*Attorney, Agent, or Firm*—Finnegan, Henderson, Farabow, Garrett and Dunner

[57] ABSTRACT

A dual line ceramic glow plug uses a ceramic heater as an incandescent body which protrudes from the bottom of a metal fitting and which is made of an incandescent wire of a refractory metal embedded in a sintered ceramic powder. The bare ends of the incandescent wire terminate in a pair of metal terminal fittings secured to the end of the ceramic heater within the metal fitting. Electrical leads protruding from the terminal fittings are welded to a pair of terminal electrodes projecting outwardly from the top of the metal fitting. The ceramic heater is held in position by a metal sheath that is slipped over and bonded to the middle portion of said heater. The middle portion of the ceramic heater is brazed to the inner surface of the metal sheath in electrically insulated relation thereto with an intervening glass layer formed on the outer surface of the ceramic heater.

9 Claims, 4 Drawing Figures

DUAL LINE CERAMIC GLOW PLUG

BACKGROUND OF THE INVENTION

The present invention relates to a dual line glow plug that is mounted in a diesel engine for preheating a precombustion chamber in the engine head.

Diesel engines are usually slow in starting up at low temperatures. In order to solve this problem, a glow plug is attached to a precombustion chamber in the engine head and an electric current is applied to the plug so that it becomes sufficiently red hot to cause partial burning of the fuel being injected into the chamber. Today, the use of such a glow plug is not limited to this purpose of preheating alone and it is more often subjected to prolonged use as an afterglow for ensuring stable combustion after engine start-up.

A conventional glow plug of the type described above is a ceramic glow plug which uses a ceramic heater as the incandescent body. This heater is comprised of an incandescent wire of a refractory or high melting point metal which is embedded within a ceramic sinter, and the heater provides a rapid increase in temperature. A commonly used ceramic glow plug is of the single line type, wherein one end of the incandescent wire in the heater is connected to the central electrode that is insulated from the metal fitting and provides a positive electrode terminal, whereas the other end of the wire is electrically connected to the metal fitting to provide a grounded electrode.

With a multi-cylinder engine, a single-line glow plug is attached to each cylinder, thus providing a parallel array of glow plugs with respect to the power supply. The individual glow plugs must be properly controlled depending upon the heating conditions that are necessitated both at engine start-up and during the ensuing afterglow. To this end, an external circuit is necessary for controlling the impressed current without changing the source voltage but by simply changing the parallel glow plug array to a series connection or vice versa. In order to operate the external circuit, terminal electrodes connected to it become necessary and this in turn necessitates a dual line glow plug. Considerable efforts have therefore been made to develop a commercial dual line glow plug and to incorporate various improvements in it.

A conventional dual line glow plug using a ceramic heater as the incandescent body is described in Published Japanese Utility Model Application No. 119045/1983 and is shown cross-sectionally in FIG. 1. A ceramic heater indicated at 1 is comprised of an incandescent wire 2 such as one made of a refractory metal which is embedded within a ceramic (e.g., $Si_3N_4$) powder and sintered thereafter. The heater 1 is inserted into a metal fitting 3 until a shoulder 1*a* formed around the middle of the heater contacts and becomes firmly secured to a step 3*a* forming a constricted portion on the inner surface close to the bottom of the metal fitting 3. One end 2*a* of the incandescent wire 2 is connected to a central electrode 4 at the top of the heater 1 which provides one electrode terminal. The other end 2*b* of the wire is connected to an electrode tube 5 slipped over the heater 1 at its top end. The electrode tube 5 is lined with a heat-resistive insulator 6 so that the central electrode 4 is fitted tight in the tube 5. The tube 5 projects from the top of the metal fitting 3 and is insulated therefrom by an insulator 7. A terminal plate 8 is secured to the tube 5 for providing the other terminal electrode.

However, the conventional dual line ceramic glow plug shown above has the disadvantage of a complex shape in that a step must be formed on both the outer surface of the ceramic heater 1 and the inner surface of the metal fitting 3. This complexity in geometry increases the cost of the plug and may often cause the breakage of the ceramic heater being assembled.

Another conventional type of dual line ceramic glow plug is described in U.S. Pat. No. 2,030,937. In accordance with the invention shown in this patent, a ceramic heater is provided with a flange that is formed on the periphery of the top end and is brought into engagement with a step formed on the inner surface of a metal fitting. Alternatively, the flange is brought into engagement with a step formed on the inner surface of the bottom of a metal element and the periphery at the bottom of the metal element is pressed inwardly so as to secure the heater to that element. However, if this ceramic heater is mounted in a diesel engine, the heater will be unable to withstand hot combustion gases, high pressure or external impact, thus causing a gas leak or an increased contact resistance, and even a broken ceramic heater.

SUMMARY OF THE INVENTION

The present invention has been accomplished in order to eliminate the above mentioned defects of the conventional dual line ceramic glow plugs. In accordance with the present invention, a dual line ceramic glow plug is provided wherein the ceramic heater is reinforced in the middle portion with a metal sheath and joined thereto, with an electrical insulating layer being present as an intervening layer. The glow plug in accordance with the present invention is easy to assemble and has improved insulation at the electrode portions.

In the conventional dual line ceramic glow plugs, the ceramic heater 1 is bonded to both the central electrode 4 and the electrode tube 5 by first metallizing, as through vapor deposition, the surface of bare ends 2*a* and 2*b* of the incandescent wire 2 projecting from the heater 1 and then by brazing the metallized ends directly to the outer surface of the central electrode 4 and the inner surface of the electrode tube 5. This bonding method is time-consuming and is not adapted to mass production.

The present invention has also been accomplished in order to solve these problems. In accordance with the present invention, a small-diameter portion is formed at the top end of the ceramic heater, and two electrode portions having incandescent wires with bare ends are formed on the outer surfaces of this small-diameter portion and part of the remainder of the heater. Metal terminal fittings are fitted over the respective electrode portions and leads protruding from the terminal fittings are welded to the central electrode and the electrode tube. Employing this arrangement, the ceramic heater can be readily joined to the two terminal electrodes (ie, the central electrode and the electrode tube), thereby enabling fabrication of the dual line ceramic glow plug.

PREFERRED EMBODIMENT OF THE INVENTION

Figure 1:
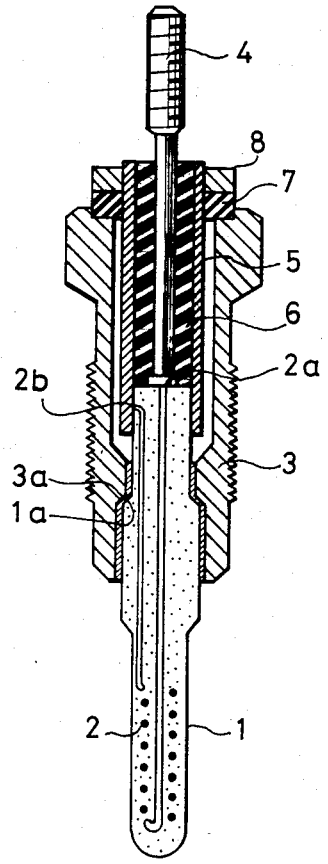
FIG. 1 is a longitudinal section through the conventional dual line ceramic glow plug.
Figure 2:
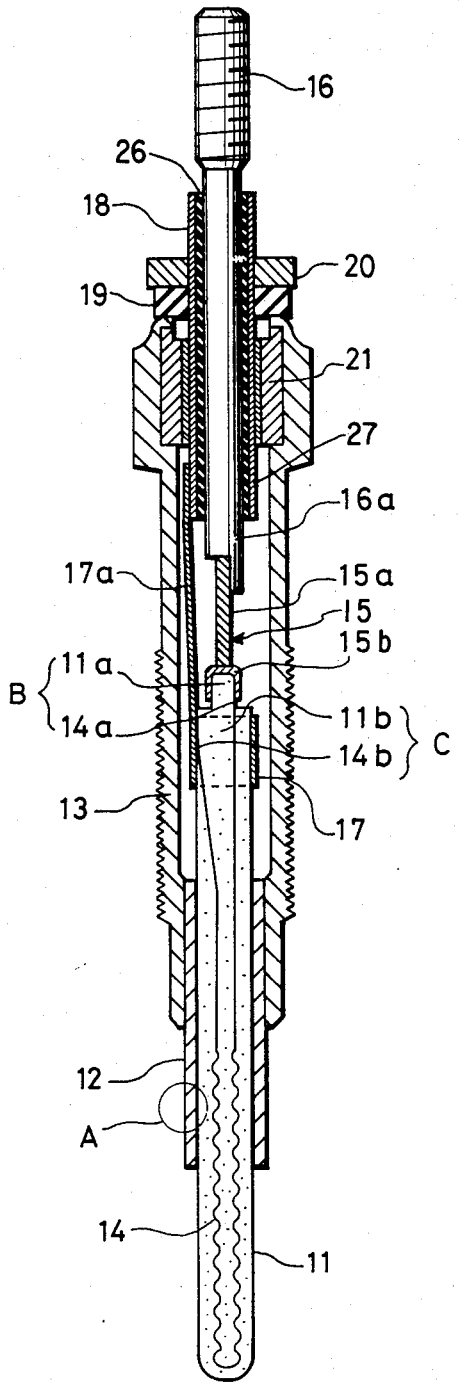
FIG. 2 is a longitudinal section of a dual line ceramic glow plug in accordance with one embodiment of the present invention.
Figure 3:
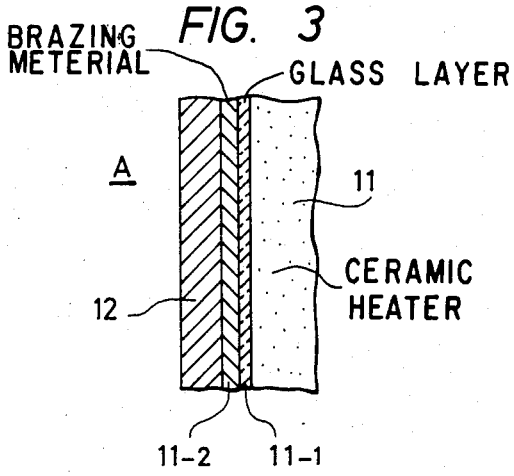
FIG. 3 is a section showing the portion A in FIG. 2 on an enlarged scale.

FIG. 2 is a longitudinal section through the dual line ceramic glow plug in accordance with one preferred embodiment of the present invention. A ceramic heater 11 comprised of an incandescent wire 14 made of a refractory metal such as tungsten or tungsten alloy imbedded within a sintered ceramic ($Si_3N_4$) powder 25 has a reinforcement in the middle portion where the heater is covered with a metal sheath 12 and is bonded to the inner surface of the latter. The metal sheath 12 is retained by being bonded to the inner surface of the lower part of a metal fitting 13. Part of the area where the ceramic heater 11 is bonded to the metal sheath 12 is circled at A and shown on an enlarged scale in FIG. 3. As shown, the outer periphery of the ceramic heater 11 is provided with a glass layer 11-1 that is formed of a baked glass powder and bonded to the metal sheath 12 through a braze layer 11-2, thus providing an electrical insulation between the heater 11 and the sheath 12.

The top end of the ceramic heater 11 is provided with a portion 11*a* that is smaller in diameter than the remainder of the heater. An exposed end 14*a* of incandescent wire 14 is attached to the outer surface of the small-diameter portion 11*a* so as to provide an electrode portion B. A first metal terminal 15 has a cap portion 15*b* slipped over the electrode portion B and a lead 15*a* welded to the metal cap portion 15*b*. Lead 15*a* extends upward and is welded to the bottom 16*a* of an axially located central electrode 16, thus providing one terminal electrode. The other end 14*b* of the incandescent wire 14, this end also being exposed, is attached to the outer surface of the large-diameter portion 11*b* adjacent the electrode portion B at the top end of the ceramic heater, thus providing the other electrode portion C. A second metal terminal 17 has a cylinder portion 17*b* slipped over the electrode portion C and a lead 17*a* projecting from the cylinder portion 17*b*. The top of the lead 17*a* is bonded to the bottom of an electrode tube 18 that is slipped over the central electrode 16 and tightly fitted to the latter, with an intervening insulator sleeve 26 present between the central electrode and the electrode tube. The electrode tube 18 is insulated from the metal fitting 13 by an insulator 19, to which a terminal plate 20 is secured to provide the other terminal electrode. The electrode tube 18 is held in position by a sleeve 21 which is also secured to the electrode tube with an insulator sleeve 27 being interposed between the two members. The central electrode 16 and the electrode tube 18 are pre-assembled before starting the fabrication of the glow plug in accordance with the embodiment shown.

Figure 4:
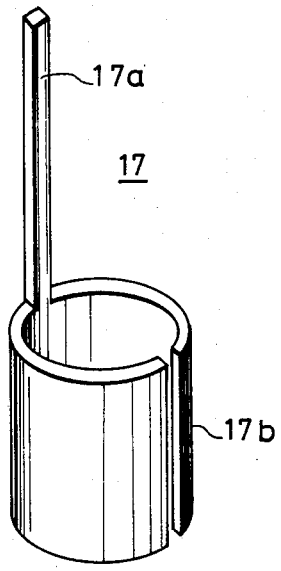
FIG. 4 is a perspective view showing the tubular metal terminal fitting in FIG. 2 on an enlarged scale.

The tubular metal terminal 17 that is to be slipped over the electrode portion C is shown on an enlarged scale in FIG. 4. A blank of a predetermined shape having the projecting lead 17*a* is punched out of a refractory metal plate and shaped to the tubular form of cylinder portion 17*b* by suitable bending techniques. The electrode portion B may also be fitted with such a tubular metal terminal instead of the cap portion 15*b*.

The incandescent wire 14 is firmly brazed to the first metal terminal 15 and second metal terminal 17, with an intervening glass layer or metallized layer formed on the outer surface of the heater except for the area to which the two exposed ends 14*a* and 14*b* of the wire 14 are attached.

The dual line ceraminc glow plug having the construction shown above in accordance with the present invention has a reinforcement wherein the middle portion of the ceramic heater is covered with the metal sheath. Because of the resulting ruggendness, the ceramic heater can be mounted on the metal fitting without breaking. The middle portion of the ceramic heater is firmly brazed to the metal sheath with a glass layer being interposed between the two members. The glass layer adds to the insulation of the electrode portions at the upper end of the ceramic heater vis a vis the metal fitting. Therefore, the plug in accordance with the present invention is free from the disadvantages of the conventional product and features easy fabrication and reliable performance.

In accordance with another feature of the dual line ceramic glow plug of the present invention, the ceramic heater is bonded to the central electrode and the electrode tube in such a manner that terminal metal fittings are slipped over the two electrode portions, one being comprised of the small-diameter section that is formed at the top end of the heater and to which an exposed end of an incandescent wire is attached and the other being composed of the remainder of the heater adjacent said small-diameter section to which the other exposed end of the incandescent wire is attached, with the leads projecting from the respective terminal fittings being connected to the central electrode and the electrode tube. Compared with the conventional type of dual line glow plug which has the electrode portions directly connected to the central electrode or metal fitting, great ease is obtained in the bonding operation. Additionally, a strong adhesion is attained by brazing the ceramic heater to the terminal fittings with an intervening glass layer, and this contributes greatly to the high-volume production of dual line glow plugs.

What is claimed is:

1. A dual line ceramic glow plug comprising:

an elongated metal fitting having an opening therethrough, a first end, and a second end;

a heater assembly comprised of an elongated sintered ceramic member having a refractory metal heater wire embedded therein, said ceramic member having an inner portion at one end thereof disposed within said opening of said metal fitting, an exposed portion at the opposite end of said ceramic member projecting from said second end of said elongated metal fitting, and a middle portion between said inner portion and said exposed portion, said heater wire having first and second ends exposed at the surface of said ceramic member proximate said one end;

first electrode means connected to said first exposed end of said wire and projecting from said first end of said elongated metal fitting;

second electrode means connected to said second exposed end of said wire and projecting from said first end of said elongated metal fitting;

means for electrically insulating said first electrode means from said second electrode means and for electrically insulating said first and second electrode means from said metal fitting;

a metal sheath bonded to said metal fitting at said second end, said metal sheath encircling said middle portion of said ceramic member while leaving said ends of said ceramic member exposed;

an insulating layer of glass bonded to the outer surface of said ceramic member on at least said middle portion; and a layer of brazing material disposed on said insulating layer and bonding said insulating layer to said metal sheath.

2. The dual line ceramic glow plug of claim 1, wherein said insulating layer is formed of sintered glass powder.

3. The dual line ceramic glow plug of claim 1, wherein said ceramic member is comprised of $Si_3N_4$.

4. A dual line ceramic glow plug, comprising:

an elongated metal fitting having an opening therethrough, a first end, and a second end;

an elongated central electrode having one end disposed within said opening of said metal fitting and another end projecting from said first end of said metal fitting;

an electrode tube surrounding a portion of and substantially concentric with said central electrode, said electrode tube having one end disposed within said opening of said metal fitting and another end projecting from said first end of said metal fitting;

means for electrically insulating said central electrode from said electrode tube and for electrically insulating said central electrode and said electrode tube from said metal fitting;

a heater assembly comprised of an elongated sintered ceramic member having a refractory metal heater wire embedded therein, said ceramic member having an inner portion at one end thereof disposed within said opening of said metal fitting and an exposed portion at the opposite end of said ceramic member projecting from said second end of said metal fitting, said inner portion of said ceramic member including a first electrode portion at said one end and a second electrode portion between said first electrode portion and said exposed portion, said first electrode portion having a smaller diameter than said second electrode portion, said heater wire having a first end exposed at the surface of said first electrode portion and a second end exposed at the surface of said second electrode portion, an intermediate portion of said wire being within said exposed portion of said ceramic member;

a first terminal including a cap portion fitted over a said first electrode portion of said ceramic member and contacting said first end of said wire, said first terminal also including a lead portion electrically connected to said one end of said central electrode; and a second terminal including a cylinder portion fitted over said second electrode portion of said ceramic member and contacting said second end of said wire, said second terminal also including a lead portion electrically connected to said one end of said electrode tube.

5. The dual line ceramic glow plug of claim 4, further comprising:

a metal sheath bonded to said metal fitting at said second end thereof and encircling said ceramic member between said second electrode portion and said exposed portion; and an insulating layer of glass bonded on the surface of said ceramic member between said ceramic member and said metal sheath, said insulating layer being bonded to said metal sheath.

6. The dual line ceramic glow plug of claim 5, further comprising a layer of brazing material disposed on said insulating layer and bonding said insulating layer to said metal sheath.

7. The dual line ceramic glow plug of claim 6, wherein said ceramic member is comprised of $Si_3N_4$.

8. The dual line ceramic glow plug of claim 4, wherein said insulating means includes a first insulator sleeve positioned between said central electrode and said electrode tube and a second insulator sleeve positioned between said electrode tube and said metal fitting.

9. The dual line ceramic glow plug of claim 8, wherein said metal fitting includes a sleeve portion secured thereto adjacent said first end of said metal fitting in contact with said second insulator sleeve, said first insulator sleeve secures said central electrode to said electrode tube, and said second insulator sleeve secures said electrode tube to said sleeve portion of said metal fitting.

* * * * *